United States Patent [19]

Ueno et al.

[11] 4,269,259

[45] May 26, 1981

[54] PULL-BACK RAM CYLINDER APPARATUS

[75] Inventors: Toyoaki Ueno, Yamaguchi; Masashi Uchida, Ube, both of Japan

[73] Assignee: Ube Industries, Ltd., Yamaguchi, Japan

[21] Appl. No.: 162,772

[22] Filed: Jun. 25, 1980

[30] Foreign Application Priority Data

Jul. 26, 1979 [JP] Japan ..... 54-94238

[51] Int. Cl.[3] ..... B22D 17/26

[52] U.S. Cl. ..... 164/303; 91/40 B; 164/343; 425/450.1

[58] Field of Search ..... 164/303, 343; 425/450.1; 91/408

[56] References Cited

U.S. PATENT DOCUMENTS

| | | | |
|---|---|---|---|
| 1,715,421 | 6/1929 | Morehead | 164/343 |
| 4,151,784 | 5/1979 | Fussangel | 91/408 X |

FOREIGN PATENT DOCUMENTS

| | | | |
|---|---|---|---|
| 652361 | 3/1979 | U.S.S.R. | 91/408 |

*Primary Examiner*—Robert D. Baldwin

*Attorney, Agent, or Firm*—Burgess, Ryan and Wayne

[57] ABSTRACT

A pull-back ram cylinder apparatus in combination with a vertical mold clamping machine to be incorporated in a vertical molding or casting machine. The pull-back apparatus comprises a hydraulic cylinder for actuating a hollow ram. A ram extension consisting of the ram and a ram rod extending into the ram in a thread engagement is slidably fitted in the cylinder. The ram rod extends downwardly from the cylinder and is connected to a movable platen of the clamping machine carrying a movable mold. The cylinder has a lower throttle portion in which radial openings for discharging an operation oil are formed in an axially spaced arrangement. The inner diameter of the throttle portion is slightly larger than the outer diameter of the ram. The throttle portion having the axially spaced openings serves, in cooperation with the head end portion of the ram, as buffering means by which the movable mold is allowed to come into contact gently with a stationary mold. The thread engagement of the ram and the ram rod is advantageous in that the positional relationship between the movable platen and the ram can be easily adjusted according to the change of the thickness in molds.

5 Claims, 3 Drawing Figures

PULL-BACK RAM CYLINDER APPARATUS

BACKGROUND OF THE INVENTION

The present invention relates to a pull-back ram cylinder apparatus in combination with a vertical mold clamping machine to be incorporated in a vertical molding apparatus such as a vertical die casting machine.

In a mold clamping machine of a vertical die casting machine, a movable platen carrying a movable mold is brought down by a main ram, actuated by a clamping cylinder, to contact the movable mold with a stationary mold in such manner that the movable mold is registered with the stationary mold, and at the step of opening the molds, the movable mold is pulled up by utilizing a pull-back ram cylinder to effect the opening of the molds. In a vertical die casting machine having the above structure, it is indispensable for the movable platen to be moved down axially at a high speed just before the stationary mold comes into contact with the movable mold, and at the mold contacting step, the speed of the movable mold should be lowered. If such movement of the movable mold is not attained, the movable mold impinges violently against the stationary mold and both the molds and other members would be damaged. Various buffering means have been proposed for this purpose, and they are defective in that the structure is complicated and the speed of the downward movement of the movable mold cannot be sufficiently controlled. For example, in a conventional die casting machine, a limit switch is actuated to switch a valve, through which hydraulic pressure is applied, to another valve, for the same purpose, having a reduced degree of the opening for the pressure oil, so that the speed of the movable mold is reduced. Alternatively, a limit switch is actuated to reduce the degree of the opening of a single valve through which the hydraulic pressure is applied. Such a limit switch is complicated in that it is difficult to determine the timing of the switching. Further, in practice, troubles, in that the switching is not timed appropriately, sometimes occur. One such trouble is that the movable mold reaches the stationary mold at a high speed. This generates a strong force and damages the molds. Still further, even if the switching is well timed, a shock is produced every time the limit switch is actuated, since the speed of the movable mold is changed quickly, that is, is not changed gradually.

In order to attain the high speed mold clamping operation which is desired, there is provided, in the conventional machine, means for effecting a cushion between the main ram and the clamping cylinder when the movable mold approaches the stationary mold, so that the movable mold is buffered against the stationary mold. The cushion means consists of, in combination, a restricted lower end portion of the clamping cylinder and an enlarged and tapered upper end portion (head end portion) of the main ram, or a restricted lower end portion of the pull-back cylinder and a tapered head portion of the pull-back ram between the restricted lower and enlarged upper portions of the ram. With such cushion means, it is not permitted to design the tapered portion so as to have a long axial length, and, under the circumstances, it is difficult to determine an optimum angle of the tapered surface relative to the axis.

SUMMARY OF THE INVENTION

An object of the present invention is to provide a pull-back ram cylinder in combination with a vertical mold clamping machine, in which combination the above mentioned disadvantages are eliminated by an improved buffering means.

According to the present invention, there is provided a pull-back ram cylinder in combination with a vertical mold clamping machine, which machine comprises a stationary hydraulic cylinder platen having a lower open end for actuating a first ram extending downwardly through the lower open end. The first ram cylinder is fixed at the lower end to a movable platen for carrying a movable mold. The pull-back ram cylinder apparatus comprises: at least a hydraulic cylinder, mounted to the stationary cylinder platen, having upper and lower open ends for actuating a second ram extending upwardly through the upper open end of the cylinder, and; a ram rod extending downwardly from the lower head end of the second ram through the lower open end of the cylinder. The lower end portion of the cylinder is restricted to form a throttle portion having an inner diameter slightly larger than the outer diameter of the second ram, which outer diameter is larger than that of the ram rod. The throttle portion of the cylinder has radial openings for discharging an operation oil. The openings are spaced apart from the neighbouring opening in an axial direction, and are communicated with corresponding lines for the operation oil. The respective lines are provided with throttles.

The throttle portion of the pull-back cylinder having the axial spaced radial openings serves, in cooperation with the head end portion of the second ram, as buffering means by which the movable mold is allowed to come into contact gently with a stationary mold.

Preferably, the lowermost opening of the throttle portion is communicated with another line for supplying the operation oil, provided with a check valve for preventing the oil from being discharged through the other line. The second ram has a bore through which the ram rod extends upwardly in such an arrangement that the ram rod is threaded on the second ram so that an axial positional relationship between the ram rod and the second ram can be changed.

The thread engagement of the second ram and the ram rod is advantageous in that the positional relationship between the second ram and the movable platen can be easily adjusted according to the change of the thickness in molds.

In the above mentioned arrangement of the present invention, it should be noted that it is no longer necessary for either the first or the second ram to have a tapered portion, as those rams in the conventional machine, as an element of the cushion means. That is, the first ram has an outer diameter substantially constant over the entire axial length, and the surface of the head end of the second ram is substantially flat.

BRIEF DESCRIPTION OF THE DRAWINGS

The present invention can be more fully understood from the following detailed description taken in conjunction with the accompanying drawings in which.

DESCRIPTION OF THE PREFERRED EMBODIMENTS

Figure 1:
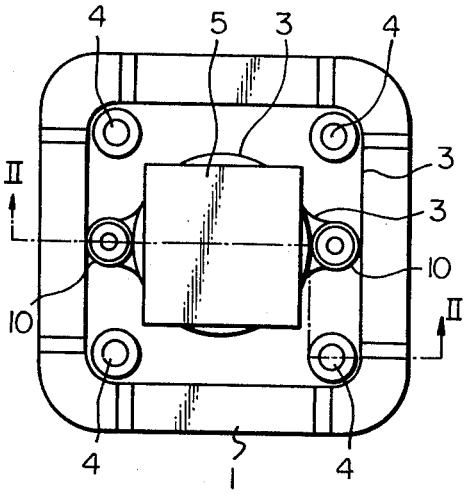
FIG. 1 is a plane view of a vertical casting machine in which a vertical mold clamping machine and a pull-back ram cylinder apparatus in combination, according to the present invention, are incorporated.
Figure 2:
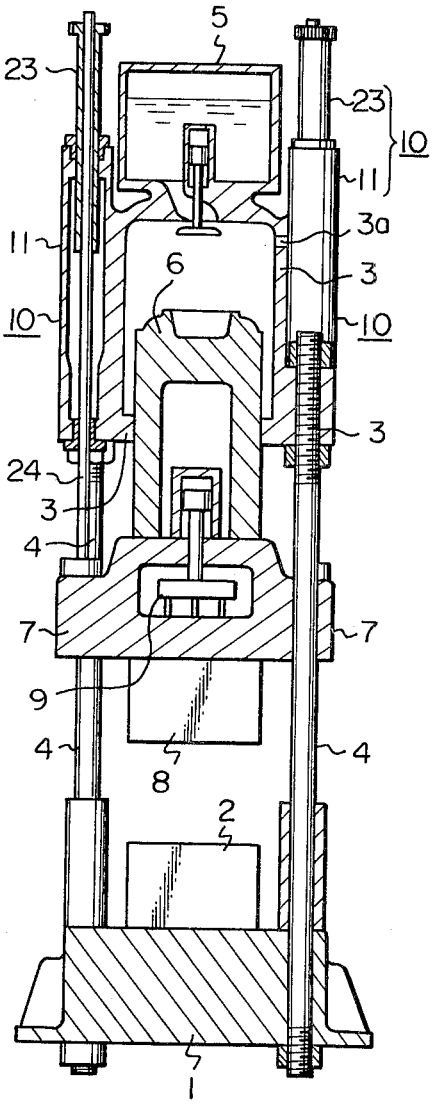
FIG. 2 is a longitudinal sectional view of the casting machine taken along the line II—II in FIG. 1.

FIGS. 1 and 2 show an embodiment of a vertical casting machine, according to the present invention, having an injection machine not shown in the drawing, for injecting a molten metal into a die consisting of stationary and movable molds. Referring to FIG. 1, the vertical casting machine has a stationary platen 1 on which the stationary mold 2 is based. A stationary cylinder platen 3 confronting the stationary platen 1 is disposed above the stationary platen 1, and both platens 1 and 3 are connected to each other through four axial tie bars 4. A tank 5, containing the operation oil, is mounted on the top end of the cylinder platen 3 for actuating a main ram 6 so that the ram 6 is forced to move downwardly.

The main ram 6 is slidably fitted in the lower open end of the cylinder platen 3 and is integrally connected at the lower end to a movable platen 7 below the cylinder platen 3 and is slidable fitted in the tie bars 4. The outer diameter of the main ram 6 is constant over substantially the entire length of the ram. The movable mold 8 is secured to the lower face of the movable platen 7. A product push-out device 9 for removing a molded or casted product from the movable mold 8 is incorporated in both the movable platen 7 and the main ram 6. The cylinder platen has an opening 3*a* through which hydraulic pressure is applied to the main ram 6 to effect the clamping of the movable and stationary molds.

Reference numeral 10 represents a pull-back ram cylinder apparatus consisting of a pair of cylinders, each for actuating a pull-back ram having a flat head end. The pull-back cylinder 11 is connected integrally to the stationary cylinder platen 3 in an axial arrangement.

Figure 3:
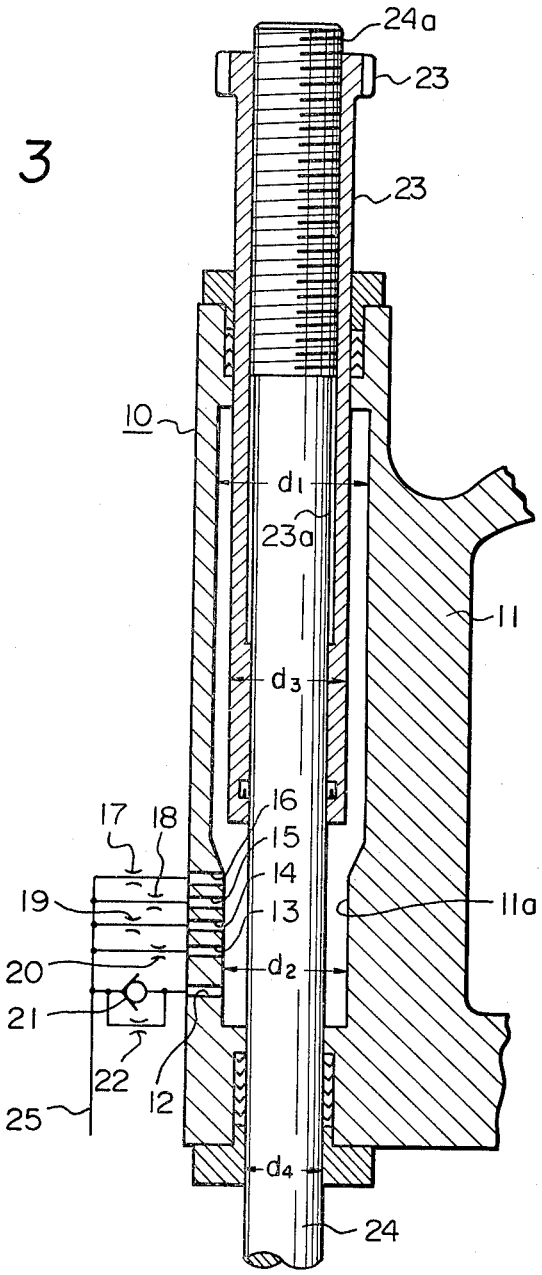
FIG. 3 is an enlarged longitudinal sectional view illustrating, in detail, the pull-back ram cylinder apparatus shown in FIGS. 1 and 2.

Referring to FIG. 3, the pull-back cylinder is denoted by reference numeral 11, while the pull-back ram is denoted by reference numeral 23. The pull-back cylinder 11 has an upper end opening and a lower end opening, and the ram 23 is slidably fitted to the upper end opening and extends upwardly from the upper end of the cylinder 11. The pull-back ram 23 has a bore through which a ram rod 24 extends upwardly and is secured to the ram 23 in the interior of the cylinder 11 in such an arrangement that the ram 23 is threaded on the ram rod 24. The ram 24 is slidably fitted to the lower end opening of the pull-back cylinder 11 and extends downwardly from the lower end of the cylinder 11.

The lower end of the ram rod 24 is fixed to the movable platen 7, even though this is not shown in FIG. 3. The thread engagement of the pull-back ram 23 with the ram rod 24 is attained by a female thread 23*a* formed on the inner face of the pull-back ram 23 and a male thread 24*a* formed along a certain length on the top end portion of the ram rod 24. The upper end of the pull-back ram 23 forms a grip for the thread movement of the ram 23 relative to the ram rod 24. Accordingly, by turning the pull-back ram 23, the engaging state of the threads can be controlled, whereby the vertical positional relationship between the movable platen 7 and the pull-back ram 23 can be adjusted. Thus, the position of the pull-back ram 23 can be regulated according to the change of the thickness in molds to be attached to both the stationary platen 1 and movable platen 7.

The bore of the pull-back cylinder 11 is restricted at the lower portion to form a throttle portion 11*a*. A plurality of radial openings 12 through 16 for discharging the operation oil are formed in the axial alignment at predetermined intervals on the wall of the throttle portion 11*a*. The spaced openings are communicated with the corresponding lines provided with throttles 17 through 22, respectively. A line 25 communicated with a tank for the oil and a hydraulic pressure supply source, not shown in the drawings, is connected to the above mentioned lines. The line provided with the throttle 22 and communicated with the lowermost opening 12 is provided with a partial line having a check, or a one way, valve 21 by-passing the throttle 22, so that oil is prevented from being discharged through the by-pass line, and, in turn, the oil can be supplied into the pull-back cylinder 11 through the line 25 and then through the by-pass line and the lower most opening 12.

In the above arrangement, if the inner diameters of the main portion and lower throttle portion 11*a* of the pull-back cylinder 11, the outer diameter of the pull-back ram 23 and the outer diameter of the ram rod 24 are designated as $d_1$, $d_2$, $d_3$ and $d_4$, respectively, as shown in FIG. 2, a relation of $d_1 > D_2 > D_3 > d_4$ is established. The inner diameter $d_2$ of the throttle portion 11*a* is set at a value slightly larger, for example, 0.2 to 0.5 mm, than the outer diameter $d_3$ of the pull-back ram 23.

When the hydraulic pressure is released from the pull-back cylinder 11 through the line 25, the pull-back ram 23 and the main ram 6 connected thereto by the movable platen 7 and the ram rod 24 are moved downwardly at a high lowering speed by the entire weight of the pull-back ram 23, the main ram 4, the movable mold 8 and the movable platen 7. In this case, if necessary, the hydraulic pressure is applied to the main ram 6 through the opening 3*a*. The high lowering speed is maintained until the point just before the molds make contact, and then the lowering speed is reduced. Such reduction of the speed will be explained in the following sentences. With the downward movement of the pull-back ram 23, the oil discharging openings 16, 15, 14, 13 and 12 are closed subsequently in this order, that is, in the order from the upper openings to the lower openings, by the lower end portion of the pull-back ram 23, and the amount of the oil discharged from the interior of the pull-back cylinder 11 is gradually decreased, with the result that the speed of the downward movement of the movable platen 7 is reduced, not sharply, but gradually from a certain position where the flat head end, that is, the lower end of the pull-back ram 23 approaches the upper-most opening 16. Finally, the downward movement of the movable platen 7 and, hence, the downward movement of the movable mold 8, are stopped gently when the lowermost opening 12 is closed by the pull-back ram 23. If the relative axial position of the pull-back ram 23 to the movable platen 7 is adjusted by a manual rotation of the pull-back ram 23 relative to the ram rod 24, so that at the point of stopping the pull-back ram 23, the movable mold 8 falls in contact with the stationary mold 2, both the molds make contact with each other very gently without any collosion between the two molds. After the contact in such manner that the molds are registered with each other is completed, the main ram 6 is subjected to hydraulic pressure through the opening 3*a* from the hydraulic pressure source, so that the clamping of the molds is attained.

After the hydraulic pressure subjected to the main ram 3 is released, the hydraulic pressure is applied to the pull-back cylinder 11 from the pressure source through the line 25, the check valve 21 and the lowermost opening 12, so that the pull-back ram 23 and the main ram 6 are returned to the upper original positions.

As will be understood from the above, according to the present invention, operational efficiency of the vertical casting machine can be improved and operational safty of the same can be enhanced. Furthermore, by manually adjusting the state of the thread engagement between the ram rod and the pull-back ram, the braking point, that is, the point of commencing the reduction of the speed of the downward movement, can be appropriately adjusted according to the change of the thickness of the molds to be used.

We claim:

1. A pull-back ram cylinder apparatus in combination with a vertical mold clamping machine including a stationary hydraulic cylinder platen having a lower open end for actuating a first ram extending downwardly through the lower open end of said cylinder platen, said first ram being fixed at the lower end thereof to a movable platen for carrying a movable mold, said apparatus comprising: at least a hydraulic cylinder, mounted to said cylinder platen, having upper and lower open ends for actuating a second ram extending upwardly through the upper open end of said cylinder, and; a ram rod extending downwardly from the lower head end of said second ram through the lower open end of said cylinder, the lower portion of said cylinder being restricted to form a throttle portion having an inner diameter slightly larger than the outer diameter of said second ram, which outer diameter is larger than that of said ram rod, said throttle portion having radial openings for discharging an operation oil, said openings being spaced apart from the neighbouring opening in an axial direction, said spaced openings being communicated with corresponding lines for the operation oil.

2. A pull-back ram cylinder apparatus as claimed in claim 1, wherein said lines for the operation oil are provided with throttles, respectively.

3. A pull-back ram cylinder apparatus as claimed in claim 2, wherein said lowermost opening of said throttle portion is communicated with another line for supplying the operation oil provided with a check valve for preventing the oil from being discharged through said other line.

4. A pull-back ram cylinder apparatus as claimed in any one of claims 1, 2 and 3, wherein said second ram has a bore through which said ram rod extends upwardly in such an arrangement that said ram rod is threaded on said second ram so that an axial positional relationship between said movable platen and said second ram can be changed.

5. A pull-back ram cylinder apparatus as claimed in claim 4, wherein said first ram having an outer diameter substantially constant over the entire axial length, while the surface of the head end of said second ram is substantially flat.

* * * * *